United States Patent [19]

Prahauser et al.

[11] 4,324,183

[45] Apr. 13, 1982

[54] SMOKE PROJECTILE CHARGE

[75] Inventors: Georg Prahauser, Oberalm, Austria; Robert Schmidlin, Neuenburg; Wolfgang Trede, Weil-Otlingen, both of Fed. Rep. of Germany

[73] Assignee: Buck Chemisch-Technische Werke GmbH & Co., Bad Uberkingen, Fed. Rep. of Germany

[21] Appl. No.: 77,744

[22] Filed: Sep. 21, 1979

[30] Foreign Application Priority Data

Sep. 26, 1978 [DE] Fed. Rep. of Germany ..... 2841815

[51] Int. Cl.[3] ..... F42B 13/44; F42C 19/02

[52] U.S. Cl. ..... 102/334; 102/370; 102/487; 102/275.3

[58] Field of Search ..... 102/101, 60, 90, 334, 102/364, 370, 487, 279.3

[56] References Cited

U.S. PATENT DOCUMENTS

| | | | |
|---|---|---|---|
| 2,405,085 | 7/1946 | Zappone | 102/278 |
| 3,951,067 | 4/1976 | Schroeder | 102/90 |
| 4,002,121 | 1/1977 | Prochnow | 102/90 |
| 4,043,268 | 8/1977 | Fischer | 102/90 |
| 4,186,664 | 2/1980 | Huber | 102/66 |

*Primary Examiner*—Richard E. Schafer
*Assistant Examiner*—Edward F. Miles
*Attorney, Agent, or Firm*—Kenway & Jenney

[57] ABSTRACT

A smoke cup projectile charge comprising smoke cups stacked one above the other in the shell jacket in discharging direction, the smoke cup supporting components having identical strength and being filled with smoke charge composition comprising hexachloroethane, zinc oxide and metal powder, and a fuse system of priming cartridges embedded in transmission composition in the smoke charge and ignited by capillary delay tubes.

5 Claims, 1 Drawing Figure

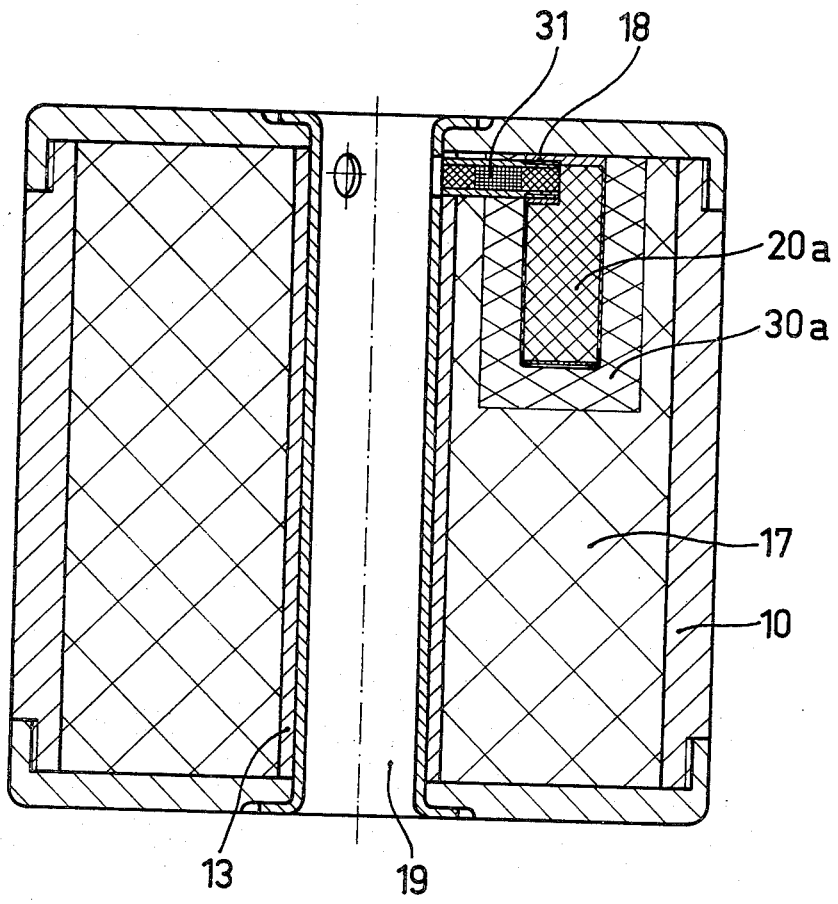
31
18
20a
30a
17
10
13
19

SMOKE PROJECTILE CHARGE

BACKGROUND OF THE INVENTION

The invention relates to a projectile charge of smoke cups, which are arranged stacked one above the other in the shell jacket in discharging direction. The smoke cups consist of a closed metal case with a thereinhoused smoke composition comprising hexachloroethane, zinc oxide and metal powder. The smoke cups rest one upon another with total surface contact, and the component parts of each cup case consist of the same material, the supporting components having identical strength and the smoke composition charge fully filling out the cases. The metal cases consist of two coaxial tubes which form between themselves an annular chamber for the smoke composition, which chamber is covered on both sides through annular lids. The smoke composition is highly compressed with a pressure of at least 1300 kp/cm$^2$ [91 PSI] and is thus self-supporting in itself. There is finally provided a fuse arrangement of three priming cartridges, which are embedded in the smoke composition charge symmetrically to the center line of the smoke cup, and the spacing between each priming cartridge and the inner tube is 5 to 10 mm.

In the projectile charge of copending application Ser. No. 752,637, "Smoke Projectile Charge and Process For its Manufacture", filed Dec. 8, 1976 now U.S. Pat. No. 4,186,664 issued Feb. 5, 1980, the manufacturing of the smoke cup is carried out in that smoke composition and detonating charge, that is, priming cartridges, are jointly compressed into a block of uniform compression. To be sure, the detonation process of smoke composition charges manufactured in this manner is satisfactory, but the manufacturing process itself presents certain difficulties; for one, it is comparatively intricate, and for the other—and this is the more important point—it is not without danger because of the high pressures applied the danger of self-ignition of the detonation composition and thereby of a spontaneous reaction of the smoke composition cannot be excluded.

An object of the present invention is therefore to further develop projectile charges in accordance with above-cited U.S. Pat. No. 4,186,664 in such a way that the manufacturing of the smoke cups becomes simple and totally safe, and that the detonation process is not adversely affected.

DESCRIPTION OF THE INVENTION

The present invention solves this problem by embedding each of the priming cartridges in a transmission composition and inserting a block consisting of priming cartridge and transmission composition and compressed at smoke composition compression pressure in recesses of the compressed smoke composition and providing communication of the priming cartridges with the internal space of the inner tube of the case via capillary delay tubes.

The invention is based on findings which resulted from protracted investigation and experiments. In order to get away from the aforesaid joint compression of detonation composition and smoke composition, the procedure has at first been that the smoke composition has been compressed, that then cylindric blind holes have been recessed into the smoke composition and that also grooves connecting the blind holes with the inner space of the inner tube of the case have been recessed and that finally the priming cartridges have been inserted into the blind holes. No detrimental effect was observed on burning-off tests at the stand. However in free flight, the smoke reaction started spontaneously directly after the discharge, but when striking the ground it broke off. Only after several minutes did it again start up. In some cases it did not resume at all.

The cause of this astonishing effect was clarified in extensive investigations and experiments. On discharge and ignition of the smoke cups the hot ignition ray enters with a pressure of 300 bar [4,260 PSIG] through the orifice of the inner tube to the case of the priming cartridge via the cavities that are unavoidable on account of the subsequent insertion of the priming cartridge. Its mechanical and thermal energy is sufficient to tear open the case and to ignite the detonation composition over a large area. The resulting rapid burning-off of the detonation composition effects for its part again an extremely spontaneous and intensive start of the smoke reaction.

During its reaction the glowing composition is briefly in a liquid phase. It is therefore partially ejected through the suction arising during the flight at the opening of the inner tube and also through the outwardly acting pressure of the outflowing smoke clouds. Thereby in addition parts of the already reacting smoke composition are pulled along. In this way the mass of ignited, glowing composition has been considerably reduced by the time it hits the ground and the cavity in which it was embedded has become enlarged. The close contact between ignited composition and smoke composition therefore no longer exist, i.e. the transmission of heat is no longer optimal. In addition on impact everything is jumbled about, whereby the reacting smoke layer crumbles off from the residual smoke composition.

The interplay of all these parameters causes the reaction to break off and begin again only after an extended period—if at all. In order to exclude the adverse factors a cylindric body that consists of the priming cartridge and a surrounding tubular smoke composition body was pressed first and then this jointly compressed cylindric body was inserted into the recesses of the actual smoke composition charge. It is noted that it is simpler and safer to compress priming cartridge jointly with a relatively small amount of smoke composition than with the whole smoke composition charge. In this way it was possible to prevent the large-area ignition of the priming composition, and thereby the spontaneous burning-off, but on the other hand the burning-off behavior was now disturbed because of the gap in the smoke composition charge itself. In the stationary test there could be observed only a weak break of the smoke reaction, but in free flight this break was considerably more pronounced because of the jolt on ground impact, and resulted in some cases even in a break-off of the reaction.

The problem was finally resolved by arranging a delay before each of the priming cartridges which bridged the flying time so that the priming cartridges became effective only after striking ground. Because of the high compression of the smoke composition charge and the gap-free build-up of the smoke cup the jolt on ground impact had no effect on the course of the functions so that in this way it was possible to reproduce the conditions of the stationary test.

It is essential that an over-ignition from the propellant charge to the ignition composition through by-passing the delay piece be reliably prevented. For this purpose the delay piece is screwed into the case of the priming cartridge right up to the base of the threads and the threads are additionally sealed with an adhesive that is compatible with hexachloroethane.

Finally, the previously mentioned weak in the smoke reaction caused by the gap between smoke composition charge and inserted pressed body can also be prevented if one uses for the pressed body a more rapidly, and therefore a hotter-reacting, smoke composition. This is accomplished in a simple manner by increasing the aluminum content while maintaining the other smoke composition components. Through this method it is possible to achieve a seamless transition from the pressed body to the main composition charge. The pressed body acts thus as transmission piece from the priming cartridge to the smoke composition charge. Through the quicker reaction of this transmission piece there is simultaneously achieved a more spontaneous and more intensive start of the smoke.

To resolve the object of the invention to total satisfaction the combination of all aforementioned measures and/or features was required.

The FIGURE is a drawing showing a longitudinal cut through a smoke cup with priming system.

The smoke cup or pot comprises the smoke cup case 10, the inner tube 13, the inner space of the inner tube, that is, the degasification channel, and the apertures 18 of the inner tube 13 opening into the degasification channel 19. The single priming cartridge visible in the drawing—there are three altogether—has the reference symbol 20*a*. As can be seen this priming cartridge 20*a* is surrounded by a transmission composition-set 30*a*. A capillary delay tube 31 connects the priming cartridge 20*a* with the opening 18.

In manufacturing the case 10 is first filled with the smoke composition charge 17 and this is compressed with a pressure of about 1300 kp/cm$^2$ [91 PSI] in such a way that the compressed smoke composition 17 fills out the case up to the plane of the lid. Further, under the same conditions of pressure there is pressed an insertion body that consists of the priming cartridge 20*a* and the transmission composition-set 30 surrounding this. Thereupon a vertical blind hole and also a horizontal groove are recessed into the compressed smoke composition charge 17, and into the blind hole is inserted the insertion body consisting of the priming cartridge 20*a* and transmission composition-set 30, and into the groove is inserted the capillary delay tube 31. Thereupon the smoke cup is then closed through the lid 15*a*.

The transmission composition 30 consists advantageously of a smoke composition material and has the same composition as the smoke composition charge 17, but with a higher percentage content of aluminum powder. The transmission composition 30 is thus a smoke composition material like the smoke composition charge 17, but of better ignition quality. The capillary delay tube 31 can have an external thread and can be screwed into an internal thread of the aperture 18, if desired, against a sealed stop. The threads can likewise be sealed through an adhesive. A firm seal is meant to ensure that the vehement ignition ray is only able to ignite the capillary tube 31 but can not penetrate into the interior of the case.

Having thus described our invention, we claim:

1. A projectile charge of smoke cups adapted to be stacked one above the other in a shell jacket in discharging direction, the smoke cups comprising a closed metal case with a smoke charge comprising hexachloroethane, zinc oxide and metal powder fully filling the case, the smoke cups being adapted to rest one upon another with total surface contact, and the component parts of each cup case consisting of the same material, whereby the supporting components have identical strength, the metal cases consisting of two coaxial tubes which form between themselves an annular chamber for the smoke composition charge, which chamber is covered on both sides by annular lids, and wherein the smoke composition charge is highly compressed with a pressure of at least 1300 kp/cm$^2$ [91 PSI] and is thus self-supporting in itself, said charge having a fuse system comprising three priming cartridges embedded in transmission composition and compressed at the smoke composition charge pressure inserted in recesses in the compressed smoke composition charge, symmetric about the center line of the smoke cup, the spacing between each priming cartridge and the inner tube being 5 to 10 mm, said priming cartridges being in communication with the interior of the inner tube of the case via capillary delay tubes whereby reliable, uninterrupted smoke production is achieved.

2. A projectile charge according to claim 1 wherein the metal powder is aluminum and the transmission composition has a composition similar to the smoke charge composition but with an increased content of aluminum powder.

3. A projectile charge according to claim 2 wherein the capillary delay tube is screwed into an aperture in the inner tube up to a thread stop and the screw threads are sealed off by means of an adhesive.

4. A projectile charge according to claim 1 wherein the capillary delay tube is screwed into an aperture in the inner tube up to a thread stop and the screw threads are sealed off by means of an adhesive.

5. A projectile charge of smoke cups adapted to be stacked one above the other in a small jacket in discharging direction, the smoke cups comprising a closed metal case with a smoke charge comprising hexachloroethane, zinc oxide and metal powder fully filling the case, the smoke cups being adapted to rest one upon another with total surface contact, and the component parts of each cup case consisting of the same material, whereby the supporting components have identical strength, the metal cases consisting of two coaxial tubes which form between themselves an annular chamber for the smoke composition charge, which chamber is covered on both sides by annular lids, and wherein the smoke composition charge is highly compressed with a pressure of at least 1300 kp/cm$^2$ [91 PSI] and is thus self-supporting in itself, said charge having a fuse system comprising at least one priming cartridge, this cartridge being embedded in a transmission composition and compressed with the transmission composition at the smoke composition charge pressure to form a block which is inserted in a recess in the compressed smoke composition charge, said transmission composition comprising the same components as the smoke composition and said priming cartridge being in communication with the interior of the inner tube of the case via a capillary delay tube whereby reliable, uninterrupted smoke production is achieved.

* * * * *